US009233571B2

(12) United States Patent
Bode

(10) Patent No.: US 9,233,571 B2
(45) Date of Patent: Jan. 12, 2016

(54) PRECIOUS METAL INGOT

(71) Applicant: McPatent GmbH, München (DE)

(72) Inventor: Ingolf Bode, Unterscheißheim (DE)

(73) Assignee: McPatent GmbH, Munich (DE)

( * ) Notice: Subject to any disclaimer, the term of this patent is extended or adjusted under 35 U.S.C. 154(b) by 0 days.

(21) Appl. No.: 14/601,260

(22) Filed: Jan. 21, 2015

(65) Prior Publication Data

US 2015/0210104 A1 Jul. 30, 2015

(30) Foreign Application Priority Data

Jan. 24, 2014 (DE) ..... 10 2014 000 778

(51) Int. Cl.

| | |
|---|---|
| ***B65D 25/04*** | (2006.01) |
| ***B42D 15/00*** | (2006.01) |
| ***C22C 5/00*** | (2006.01) |
| ***B65D 85/00*** | (2006.01) |
| ***C22C 5/02*** | (2006.01) |

(52) U.S. Cl.

CPC ..... *B42D 15/0073* (2013.01); *B65D 25/04* (2013.01); *B65D 85/70* (2013.01); *C22C 5/00* (2013.01); *C22C 5/02* (2013.01); *Y10T 428/12188* (2015.01); *Y10T 428/12194* (2015.01)

(58) Field of Classification Search

CPC ..... Y10T 428/12188; Y10T 428/12194

See application file for complete search history.

(56) References Cited

FOREIGN PATENT DOCUMENTS

| | | | |
|---|---|---|---|
| DE | 2107213 | A | 8/1972 |
| DE | 3040052 | A1 | 6/1982 |
| DE | 3876620 | T2 | 12/1989 |
| DE | 102010030128 | A1 | 5/2011 |
| WO | 0016932 | A1 | 3/2000 |

*Primary Examiner* — Adam Krupicka

(74) *Attorney, Agent, or Firm* — David P. Dickerson

(57) ABSTRACT

Proposed is a minted bar (1) made of a precious metal, which is formed as a rectangular single piece and partitioned into individual miniature bars (2) by straight grooves (3, 4) extending across the upper surface in longitudinal and transverse direction, wherein the grooves (3, 4) form separation points at which the individual miniature bars (2) can be manually separated from each other, wherein at each individual miniature bar (2) the information over the fine weight and the precious metal and the fineness is present, wherein at least one of the grooves (3, 4) is formed as a long groove (4) that extends over the entire length or width of the minted bar (1) and that is characterized in that at least one of the grooves (3, 4) is formed as a short groove (3), which extends in a normal direction relative to the long groove (4) and further terminates at the long groove (4).

15 Claims, 1 Drawing Sheet

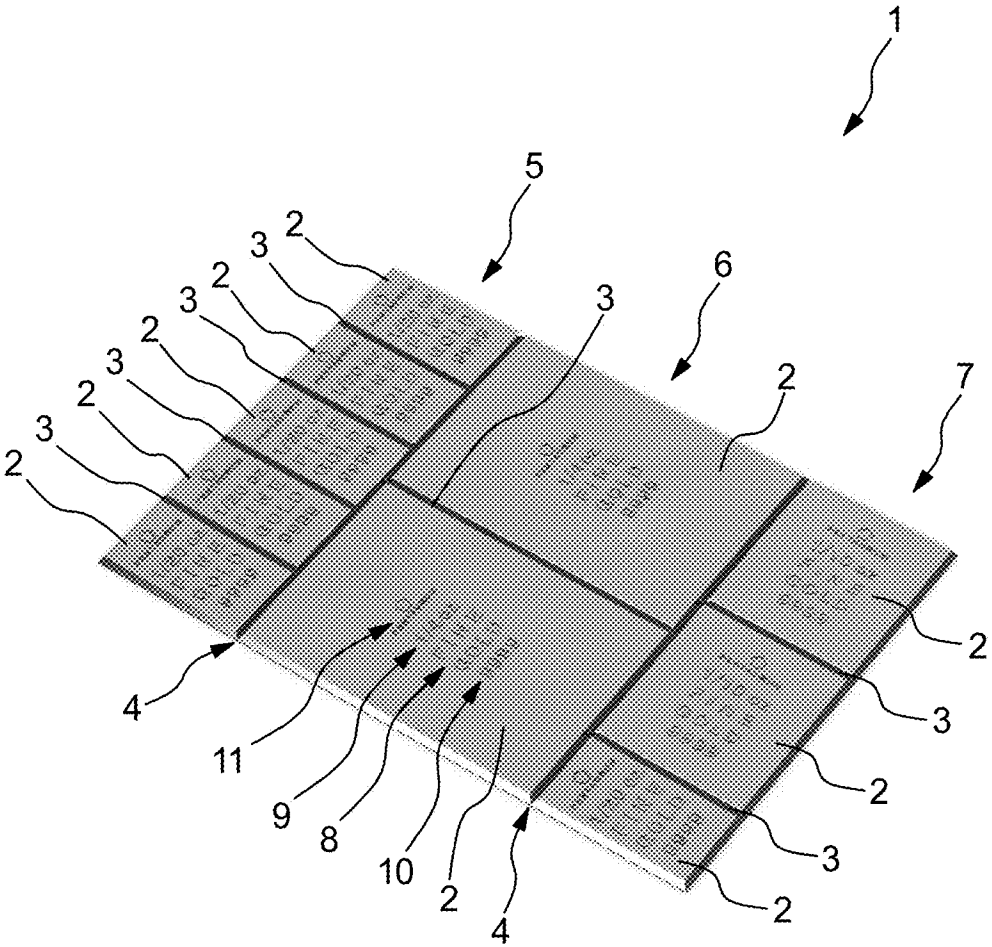
1
2
3
4
5
6
7
8
9
10
11

PRECIOUS METAL INGOT

BACKGROUND OF THE DISCLOSURE

1. Field of the Disclosure

The invention relates to a minted bar made of precious metal.

2. Description of the Related Art

From the patent application DE 10 2010 030128 A1 a minted bar made of precious metal is known. Such minted bar is currently offered as 50 g minted and 100 g minted consisting of a plurality of interconnected miniature bars of the same size or weight, each having a fine weight of 1 g (fine gold, fine platinum) or 10 g (silver). The materials information "made of precious metal" specifically includes a precious metal having a fineness for gold, silver, and platinum of about 999.9/1000 gold, 999/1000 silver and 999.5/1000 platinum. The acquisition of such a minted bar with, for example, 100 1 g miniature bars is particularly advantageous compared to the acquisition of the according number of single 1 g bars, but more expensive than the acquisition of a 100 g standard bar. This is due to the fact that for known minted bars additional material, albeit a relatively small amount, is needed in comparison with standard bars of the same size in order to be able to ensure an impressed or embossed fine weight of precious metal for each miniature bar included in the minted bar.

A continuous metal band (for example of fine gold of a 999.9/1000 fineness) that is typically rolled up can be used for the manufacture of large quantities of minted bars as well as for bars manufactured according to a conventional embossing process. After the unrolling and possibly further processing steps such as, punching, etc., the embossing and, thus, the partition of each minted bar by means of grooves may be done in a single step, respectively. For this, dimensional accuracy and quality of the height of the embossed minted bar is particularly crucial for the required material addition, with the provision that better results are achievable with hydraulic presses of 2,000 t than with hydraulic presses of 400 t. For minted bars embossed with lighter hydraulic presses a higher amount of additional material is to be expected. Furthermore, these minted bars may still have a slight shape memory according to the originally rolled metal band and may therefore form a concave surface on the side of the grooves due to insufficient deformation. This disadvantageous form may for example complicate the storage of such minted bars in designated Plexiglas receptacles, since those may be pushed open or accidentally opened by the curved minted bars.

SUMMARY OF THE PRESENT DISCLOSURE

In view of the above, it is an object of the present disclosure to provide a minted bar that requires less additional material and costs thus less to manufacture and which forms a planar surface when using a lower embossing pressure. Furthermore, a minted bar is to be provided that still can be partitioned into individual miniature bars, but has an increased stability against breakage at least in one direction.

The problem may solved by a minted bar according to claim 1. The depending claims provide additional improvements.

It is an unexpected result that the inclination of the curvature resulting from the metal band can be reduced by providing a minted bar made of a precious metal, which is formed as a single piece and partitioned into individual miniature bars by straight grooves extending across the upper surface of the minted bar, wherein the grooves form separation points at which the individual miniature bars can be manually separated from each other, wherein at each individual miniature bar the information over the fine weight and the precious metal and the fineness is present, characterized in that at least one of the grooves is formed as a short groove, and terminates at another groove.

It is an unexpected result that the inclination of the curvature resulting from the metal band can be reduced by providing a minted bar made of a precious metal, which is formed as a rectangular single piece and partitioned into individual miniature bars by straight grooves extending across the upper surface in longitudinal and transverse direction, wherein the grooves form separation points at which the individual miniature bars can be manually separated from each other, wherein at each individual miniature bar the information over the fine weight and the precious metal and the fineness of the miniature bar is present, wherein at least one of the grooves is formed as a long groove that extends over the entire length or width of the minted bar and that is characterized in that at least one of the grooves is formed as a short groove, which extends in a normal direction relative to the long groove and further terminates at the long groove in a preferred embodiment.

In another embodiment this may be achieved by replacing at least one long groove of a known minted bar with a short groove that is not continuous but ends at a further long groove. Particularly along the long grooves extending in a longitudinal direction of the known minted bar the above mentioned inclination of the curvature appeared parallel to the groove. Due to the presence of the short groove an inhomogeneous material distribution is realized when observed in the direction of this groove over the entire length or width, accordingly. This inhomogeneous material distribution reduces on the one hand the inclination of the curvature parallel to the groove and prevents on the other hand the breaking of the minted bar at the short groove until the in normal direction adjoining long groove is broken of.

It is understood that the number of long grooves and the number of short grooves depends particularly from the number and the size of the individual miniature bars. A ratio between the number of long grooves and the number of shorts grooves in the range from about 0.2 to 0.5, and thus, for example, 3 long grooves and 9 short grooves or 2 long grooves and 7 short grooves, was found to be advantageous.

The form of the minted bar in accordance with an embodiment of the present invention resulting from the arrangement of the special grooves was fond to be especially advantageous, since the minted bar may now include a easily manageable denomination of various individual miniature bars, which can not be achieved with the miniature bars of known minted bars, at least not with the known uniform matrix form.

The reduction of the overall length of the grooves relative to the surface of the minted bar and further the reduction of the number of individual miniature bars compared to the above described known minted bars in matrix form can be seen as a further advantage. It is understood, that with a lower number of individual miniature bars also proportionally less additional material is needed.

Provided that the grooves of the minted bar do not intersect with each other at any point, an unintended breaking of the minted bar in one direction, i.e. in the longitudinal direction or in the transverse direction, can be effectively prevented.

Preferably, the minted bar comprises individual miniature bars of various fine weights selected from the group of 0.5 g, 1 g, 2 g, 10 g, 50 g, and 100 g, such that each of those individual miniature bars possesses a daily tradable standard weight and such that the minted bar can be usefully divided, such as observable with known denominations of coins or bills during every day cash transactions.

Alternatively, it is preferred that the individual miniature bars have various fine weights selected from the group of 1/20 ounce, 1/10 ounce, 1/4 ounce, 1/2 ounce, 1 ounce, and 2 ounces.

As a highly preferred embodiment, a minted bar comprising a fine weight of 1 ounce and including two individual miniature bars with a fine weight of a quarter ounce each, two individual miniature bars with a fine weight of a tenth ounce each, and six individual miniature bars with a fine weight of a twentieth ounce each is proposed.

It is a further object of an embodiment of the present invention that the at least one short groove terminates with its other end at a further long groove.

According to the advantageous embodiments of the present invention, a receptacle suitable for planar reception of a minted bar in accordance with an embodiment of the present invention comprises trays, wherein one of the trays includes a number of recesses that correspond to the number of individual miniature bars of the minted bar, wherein the recesses are adapted to the base area of the individual miniature bars and are separated from each other by partition walls, wherein the form and arrangement of the partition walls correspond to the form and the arrangement of the grooves within the minted bar. This is especially advantageous since broken off individual miniature bars can be stored together with the remainder of the minted bar in a single receptacle.

BRIEF DESCRIPTION OF THE DRAWINGS

In the following embodiments of the invention are explained in greater detail, by way of example only, making reference to the drawings in which:

FIG. 1 schematically shows an embodiment of a minted bar in accordance with the present disclosure.

DETAILED DESCRIPTION

FIG. 1 shows in a perspective view a minted bar 1 of one ounce of fine gold with a fineness of 999.9/1000. The minted bar 1 includes in total ten individual miniature bars 2, which are connected to each other by grooves 3, 4 to form a single piece. The grooves do not form intersection points. A row 5, shown left in the figure, includes five individual miniature bars 2 of 1/20 ounce each that are connected to each other by four short grooves 3. A center row 6 including two individual miniature bars 2 of 1/4 ounce of fine gold weight each is shown adjacent to the row 5. The two rows 5, 6 are connected to each other by a long groove 4 that extends over the entire width of the minted bar 1. The in longitudinal direction extending short grooves of the left row 5 encounter thereby the in traverse direction extending first long groove 4 at a right angle and terminate there. A row 7 joins on the right hand side of the figure via a second long groove 4. The row 7 includes two 1/10 ounce individual miniature bars 2 and one 1/20 ounce individual miniature bar, which are connected to each other also by short grooves. If the minted bar 1 is to be disassembled into its individual miniature bars 2, then it is initially only possible to manually break off one of the outer rows 5, 7 at one of the long groves 4 from the remainder of the minted bar 1. Subsequently, the individual miniature bars of the separated row can be separated from each other. With that it is initially not possible to break the minted bar 1 in longitudinal direction and, thus, in normal direction relative to one of the long grooves 4, which facilitates a secure handling during the separation of the individual miniature bars and particularly increases the stability of the minted bar. The short groove 3 of the center row 6 can only be broken when first the left and the right row have been broken off, since both ends of this short groove 3 terminate at a long groove 4.

Each of the individual miniature bars 2 shows in raised embossing a manufacturer's logo 11, further an indication of its material 8, namely fine gold, and its fine gold weight 9, i.e. 1/20, 1/10 or 1/4 ounce as well as a fineness 10, here 999.9/1000 depicted with 9999.

Not shown is a receptacle suitable for planar reception of a minted bar in accordance with the figure. The receptacle comprises trays of transparent Plexiglas, wherein one of the trays includes a number of recesses that correspond to the number of individual miniature bars of the minted bar 1 and, thus, 10 is. The recesses are adapted to the base area of the individual miniature bars and are separated from each other by partition walls, wherein the form and arrangement of the partition walls correspond to the form and the arrangement of the grooves within the minted bar. Consequently, the minted bar can be securely stored even in a completely disassembled state.

While the invention has been described above by reference to various specific embodiments, it should be understood that numerous further alternative embodiments may exist within the spirit and scope of the inventive concepts described by combination of technical features that are disclosed and further known to a person skilled in the art or otherwise obvious. Accordingly, it is intended that the invention not be limited to the described embodiments, but will have full scope defined by the language of the following claims. Furthermore, the foregoing description may indicate to those skilled in the art an appropriate way to implement an exemplary embodiment. Many changes may be made relative to the function, number, and arrangement of the individual miniature bars and all the other mentioned elements without departing from the disclosed scope of the claims and equivalents thereof.

LIST OF REFERENCE NUMERALS

1 minted bar
2 individual miniature bar
3 short groove
4 long groove
5 row
6 row
7 row
8 indication of material
9 indication of weight
10 indication of fineness
11 manufacturer logo

The invention claimed is:

1. An ingot, comprising:

a unitary cuboid body of precious metal, said unitary cuboid body having an upper side, a lower side opposite said upper side, a first edge side, a second edge side opposite said first edge side, a third edge side and a fourth edge side opposite said third edge side;

a plurality of grooves in said upper side, said plurality of grooves dividing said unitary cuboid body for manual separation into sub-ingots, each sub-ingot comprising a visual indication of a fine weight of the respective sub-ingot, a name of said precious metal and a purity of said ingot, wherein said plurality of grooves comprises:

a first groove extending in a straight line from said first edge side to said second edge side; and a plurality of second grooves, each of said second grooves extending in a straight line perpendicular to said first groove and having a first end at said third edge side and a second end at said first groove;

a third groove extending in a straight line parallel to said first groove from said first edge side to said second edge side;

a plurality of fourth grooves, each of said fourth grooves extending in a straight line perpendicular to said third groove and having a first end at said fourth edge side and a second end at said third groove.

2. The ingot of claim 1, wherein none of said plurality of grooves crosses another of said plurality of grooves.

3. An ingot, comprising:

a unitary cuboid body of precious metal, said unitary cuboid body having an upper side, a lower side opposite said upper side, a first edge side, a second edge side opposite said first edge side, a third edge side and a fourth edge side opposite said third edge side;

a first plurality of grooves in said upper side, said plurality of grooves dividing said unitary cuboid body for manual separation into sub-ingots, wherein said first plurality of grooves comprises:

a first groove extending in a straight line from said first edge side to said second edge side; and a second groove extending in a straight line and being selected from the group consisting of:

a groove having a first end at said third edge side and a second end at said first groove;

a groove having a first end at said fourth edge side and a second end at said first groove; and a groove having a first end at said first groove and a second end at a third groove, said third groove extending from said first edge side to said second edge side without crossing said first groove and without crossing said second groove.

4. The ingot of claim 3, wherein said first plurality of grooves comprises said third groove.

5. The ingot of claim 3, wherein said first plurality of grooves comprises a second plurality of grooves, each of said second plurality of grooves extending in a straight line and having a first end at said third edge side and a second end at said first groove.

6. The ingot of claim 5, wherein said first plurality of grooves comprises a third plurality of grooves, each of said second plurality of grooves extending in a straight line and having a first end at said fourth edge side and a second end at said first groove.

7. The ingot of claim 6, wherein none of said first plurality of grooves crosses another of said first plurality of grooves.

8. A minted bar of a precious metal, said minted bar being formed as a single piece and being partitionable into individual miniature bars by straight grooves extending at least partially across an upper surface of the minted bar, the grooves forming separation lines at which the individual miniature bars can be manually separated from each other, each individual miniature bar comprising information representative of a fine weight, the precious metal and a fineness, wherein at least one of the grooves is formed as a short groove, and terminates at another groove.

9. Minted bar according to claim 8, wherein the grooves do not intersect with each other.

10. Minted bar according to claim 8, the individual miniature bars comprise individual miniature bars of various fine weights selected from the group of 0.5 g, 1 g, 2 g, 10 g, 50 g, and 100 g.

11. Minted bar according to claim 8, the individual miniature bars comprise individual miniature bars of various fine weights selected from the group of 1/20 ounce, 1/10 ounce, 1/4 ounce, 1/2 ounce, 1 ounce, and 2 ounces.

12. Minted bar according to claim 11, the minted bar has a fine weight of 1 ounce and the individual miniature bars comprise two individual miniature bars with a fine weight of a quarter ounce each, two individual miniature bars with a fine weight of a tenth ounce each, and six individual miniature bars with a fine weight of a twentieth ounce each.

13. Minted bar according to claim 8, wherein the minted bar is rectangular and the straight grooves comprise longitudinal grooves extending in longitudinal direction and traverse grooves extending in a transverse direction, wherein at least one of the straight grooves is formed as a long groove that extends over one of the entire length and the entire width of the minted bar and wherein the short groove extends in a normal direction relative to the long groove and terminates at the long groove.

14. Minted bar according to claim 13, wherein another end of the at least one short groove terminates at another groove that is a long groove.

15. Receptacle suitable for planar reception of a minted bar of a precious metal, said minted bar being formed as a single piece and being partitionable into individual miniature bars by straight grooves extending at least partially across an upper surface of the minted bar, the grooves forming separation lines at which the individual miniature bars can be manually separated from each other, each individual miniature bar comprising information representative of a fine weight, the precious metal and a fineness, wherein at least one of the grooves is formed as a short groove, and terminates at another groove, the receptacle comprising trays, wherein one of the trays includes a number of recesses that correspond to a number of the individual miniature bars of the minted bar, wherein the recesses are adapted to a base area of the individual miniature bars and are separated from each other by partition walls, wherein a form and arrangement of the partition walls corresponds to a form and arrangement of the grooves in the minted bar.

* * * * *

UNITED STATES PATENT AND TRADEMARK OFFICE

CERTIFICATE OF CORRECTION

PATENT NO. : 9,233,571 B2
APPLICATION NO. : 14/601260
DATED : January 12, 2016
INVENTOR(S) : Bode It is certified that error appears in the above-identified patent and that said Letters Patent is hereby corrected as shown below:

On the title page item (72), line 1, should read --Unterschleißheim--.

Signed and Sealed this
Fourteenth Day of June, 2016

Michelle K. Lee

Michelle K. Lee
*Director of the United States Patent and Trademark Office*